US005357082A

United States Patent [19]

Higgins

[11] Patent Number: 5,357,082

[45] Date of Patent: Oct. 18, 1994

[54] APPARATUS FOR PROVIDING VISUAL INDICATION IN AN ELECTRIC COOKING APPLIANCE

[75] Inventor: George A. Higgins, Hagley, United Kingdom

[73] Assignee: Ceramaspeed Limited, United Kingdom

[21] Appl. No.: 477

[22] Filed: Jan. 5, 1993

[30] Foreign Application Priority Data

Jan. 10, 1992 [GB] United Kingdom ..... 9200515.6

[51] Int. Cl.[5] ..... H05B 1/02

[52] U.S. Cl. ..... 219/506; 219/507; 219/448; 219/502; 219/491

[58] Field of Search ..... 219/487, 494, 486, 448, 219/449, 445–447, 502, 506, 491, 507

[56] References Cited

U.S. PATENT DOCUMENTS 4,282,422 8/1981 Payne et al. ..... 219/486
4,518,850 5/1985 Grasso ..... 219/506

FOREIGN PATENT DOCUMENTS 3942900 6/1991 Fed. Rep. of Germany ..... 219/446
2186166 1/1986 United Kingdom .

*Primary Examiner*—Mark H. Paschall
*Attorney, Agent, or Firm*—Ira S. Dorman

[57] ABSTRACT

A visual indication is provided in a heater of an electric cooking appliance which incorporates a user-operable multi-position switch for switching the heater from one power output to another. The heater incorporates at least one heating element which is capable of emitting a significant amount of visible radiation, the at least one heating element being de-energized and subsequently re-energized as the heater is switched from one power output to another. Such a heater is of particular value where the heating element is capable of emitting fewer distinct levels of visible radiation than the number of distinct heat settings of the heater selectable from the multi-position switch. The heating element may be de-energized and subsequently re-energized only between adjacent heat settings in which there is no substantial change in the level of visible radiation.

5 Claims, 3 Drawing Sheets

APPARATUS FOR PROVIDING VISUAL INDICATION IN AN ELECTRIC COOKING APPLIANCE

The present invention relates to an apparatus for providing a visual indication in a heater of an electric cooking appliance that the heater is being switched from one power output to another.

BACKGROUND OF THE INVENTION

It is well known to use a multi-position switch in conjunction with heaters, for example radiant heaters, of electric cooking appliances. The heaters are provided with two or more heating elements which are connected in various configurations to give a plurality, for example six, of different heating power outputs. The heating elements may be connected in a number of different series and parallel arrangements, possibly with the use of rectifier means and/or a bimetallic switch device to adjust the power output of one or more of the heating elements and/or possibly with the application of more than one voltage to one or more of the heating elements to give different power outputs of the heating elements.

When heating elements, for example three heating elements, are used in the form of coils of bare resistance wire the effects of any visible changes in the radiation from the coils are small. This is because the coils increase and decrease slowly in brightness relative to a typical speed of rotation of a manually operated control knob of the multi-position switch and because the coils do not give off significant amounts of visible radiation at low power outputs.

More recently, radiant heaters have incorporated heating elements in the form of infra-red lamps. Initially four lamps were used, but subsequently radiant heaters with three, two and one infra-red lamp have been introduced. Although the major part of the radiation emitted by the infra-red lamps is in the infra-red region of the spectrum, a significant part of the radiation is visible. In the case of radiant heaters with four infra-red lamps it was relatively straightforward, by connecting the lamps in various parallel and series configurations, to obtain six progressive power output levels which corresponded with progressive visible radiation from the lamps. Moreover, the change in visible radiation and in power output is fast and virtually instantaneous at high power output levels.

For radiant heaters with three or two infra-red lamps it is also possible to provide a visible radiation level that corresponds substantially to the power output level of the heater, although in some cases it may be necessary to use additional means, such as a rectifier, to adjust the power output of the heater.

Thus the user of a cooking appliance that incorporates a radiant heater with heating elements in the form of infrared lamps has become accustomed to the heater providing a substantially accurate visual feedback of the power output of the heater.

However, in the case of a radiant heater with only a single infra-red lamp heating element the possibilities for series and parallel configurations is severely limited, even where the infra-red lamp heating element is used in conjunction with one or more heating elements in the form of coils of bare resistance wire. Nevertheless, there is a demand for a radiant heater with a single infra-red lamp heating element and this is coupled with an expectation that the visible radiation from the heater will change progressively with changes in power output of the heater.

OBJECT OF THE INVENTION

It is an object of the present invention to provide a visual indication in a heater of an electric cooking appliance that the heater is being switched from one power output to another.

SUMMARY OF THE INVENTION

According to the present invention there is provided apparatus for providing a visual indication in a heater of an electric cooking appliance, the appliance incorporating a user-operable multi-position switch for switching the heater from one power output to another, the heater incorporating at least one heating element which is capable of emitting a significant amount of visible radiation, the apparatus including means for de-energising and subsequently re-energising the at least one heating element as the heater is switched from one power output to another.

The heater may incorporate at least one further heating element which, in use, does not emit a significant amount of visible radiation.

Where the at least one heating element is capable of emitting a plurality of distinct levels of visible radiation fewer than the plurality of distinct heat settings of the heater selectable from the multi-position switch, the at least one heating element may be de-energised and subsequently re-energised only between adjacent heat settings in which there is no substantial change in the level of visible radiation.

Preferably, the level of visible radiation from the at least one heating element does not reduce as the heat output setting of the heater increases.

Where the multi-position switch incorporates a plurality of rotatable cams for switching the heater from one power output to another, at least one of the cams may be profiled such as to de-energise and to subsequently re-energise the at least one heating element as the heater is switched from one power output to another.

For a better understanding of the present invention and to show more clearly how it may be carried into effect reference will now be made, by way of example, to the accompanying drawings in which:

DESCRIPTION OF PREFERRED EMBODIMENTS

Figure 1:
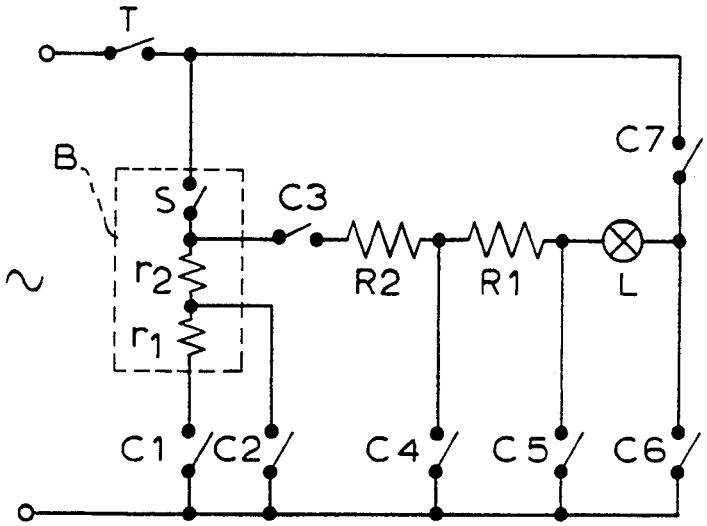
FIG. 1 is a diagrammatic illustration of one embodiment of a radiant heater and multi-position switch arrangement for an electric cooking appliance, the heater incorporating one infra-red lamp heating element and two coil heating elements.

FIG. 1 shows a switch arrangement of a multi-position switch and a radiant heater assembly of an electric cooking appliance. The radiant heater comprises a single infra-red lamp L and two resistive heating elements R1 and R2. The switch arrangement has six heat settings and incorporates seven sets of contacts C1, C2, C3, C4, C5, C6 and C7 which are opened or closed in accordance with Table 1 shown below:

TABLE 1

| | Switch position | | | | | |
|---|---|---|---|---|---|---|
| Contacts | 6 | 5 | 4 | 3 | 2 | 1 |
| C1 | | | | | X | |
| C2 | | X | | | | X |
| C3 | X | X | | X | X | X |
| C4 | | X | X | | | |
| C5 | X | | | | | |
| C6 | | | | X | X | X |
| C7 | X | X | X | | | |

X = contact closed

A bimetallic relay B includes two series-connected heating elements r1 and r2, for example in the form of a thick- or thin-film resistor provided with a tap along its length, and a bimetallic switch S. In this way, different heating powers, and thus duty cycles, can be obtained by energising different length portions of the resistor, selected by appropriate switching. In this case, any variations in the value of the resistor will affect each of its sections proportionately.

The bimetallic relay is in effect a mechanically non-adjustable energy regulator and operates by virtue of electric current passing through the heating elements r2 and possibly also r1 and causing a bimetallic member, such as a bimetallic strip or bimetallic disc, to be heated. When the bimetallic member has reached a predetermined temperature the switch opens cutting off the flow of current and causing the bimetallic member to cool and to close the switch. A thermal cut-out device T is provided to prevent overheating and can be positioned elsewhere in the circuit if desired.

In use, in switch position 6, which gives maximum power, the contacts C3, C5 and C7 are closed and the resistive heating elements R1 and R2 are connected in series with one another and are connected in parallel with the lamp L. In switch position 5, the contacts C2, C3, C4 and C7 are closed and the resistive heating element R1 is connected in series with the lamp L, while the resistive heating element R2 is connected in parallel with the combination of the lamp L and the resistive heating element R1. Because the contact C2 is closed, power passes to the bimetallic relay B by way of the heating element r2 in order to operate the bimetallic relay B at a first duty cycle, of say 25 to 30 percent of maximum power.

In switch position 4, the contacts C4 and C7 are closed and the resistive heating element R1 is connected in series with the lamp L. In switch position 3, the contacts C3 and C6 are closed and the lamp L is connected in series with both the resistive heating elements R1 and R2.

In switch positions 2 and 1, contacts C3 and C6 are closed and the lamp L is connected in series with both the resistive heating elements R1 and R2 as in switch position 3. Additionally, in switch position 2, contact C1 is closed allowing power to pass through the heating elements r1 and r2 in series to operate the bimetallic relay at a second duty cycle of say 50 to 60 per cent of maximum. In switch position 1, contact C2 is closed allowing power to pass through the heating element r2 so as to operate the bimetallic relay at the first duty cycle. It will be appreciated that the second duty cycle is higher than the first duty cycle because the heat generated to operate the bimetallic member is lower when power passes through the two heating elements r1 and r2 in series as compared with the single heating element r2 because the two heating elements in series have a higher electrical resistance and generate less heat, thus heating the bimetallic member more slowly and allowing the switch to remain closed for longer, than with the single heating element.

In switch position 6 the lamp L is operating at full power and the visible radiation is at a maximum. In switch position 5 the resistive heating element R1 is connected in series with the lamp L and the visible radiation is reduced compared with switch position 6. In switch position 4 the resistive heating element R1 is still connected in series with the lamp L and there is no change in visible radiation compared with switch position 5. In switch position 3 the lamp L is connected in series with both resistive heating elements R1 and R2 and the visible radiation is reduced compared with switch position 4. However, in switch positions 2 and 1 the lamp L is still connected in series with the resistive heating elements R1 and R2. Thus there is no actual change in visible radiation from the lamp L between switch positions 4 and 5, and, subject to the bimetallic switch S being closed, there is no actual change in visible radiation from the lamp L between switch positions 2 and 3 and between switch positions 1 and 2.

Figure 2:
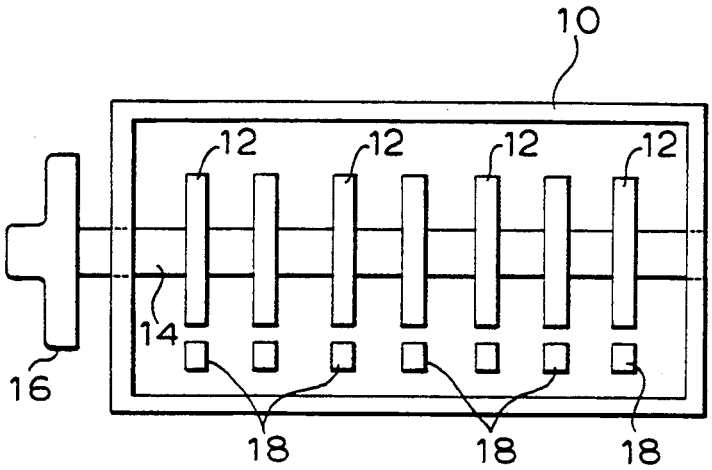
FIG. 2 is a side elevational view of a multi-position switch.

A typical multi-position switch is shown in FIG. 2 and comprises a housing 10 containing a plurality of profiled cams 12 mounted on, or moulded integrally with, a rotatable spindle 14. The spindle 14 is rotatable by means of a control knob 16. Positioned adjacent to each of the cams 12 is a movable arm 18 for operating a set of switch contacts such as those illustrated diagrammatically in FIG. 1.

Figure 3:
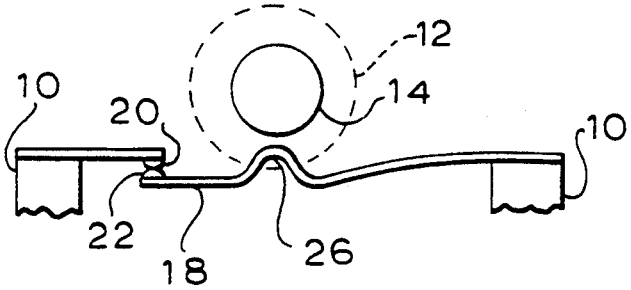
FIG. 3 illustrates one form of switch contact for use in the multi-position switch shown in FIG. 2.
Figure 4:
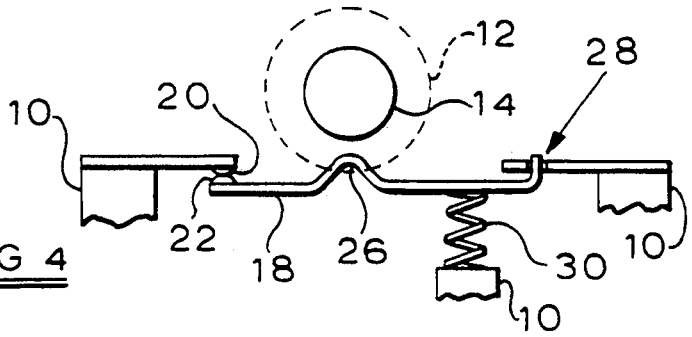
FIG. 4 illustrates another form of switch contact for use in the multi-position switch shown in FIG. 2.

The switch contacts are illustrated in more detail in FIGS. 3 and 4. In FIGS. 3 and 4 one of the contacts 20 is stationary and the other contact 22 is movable and is positioned at the end of arm 18, both contacts 20 and 22 being mounted on the switch housing 10. The arm 18 is configured to provide an upstanding, generally inverted V-shaped, portion 26 for engaging with the relevant cam 12. In FIG. 3 the arm 18 is made of a resilient material biasing the upstanding portion 26 into engagement with the cam 12, while in FIG. 4 the arm 18 is provided with a hinge 28 on that side of the upstanding portion 26 remote from the contact 22 and a spring 30 acts between the housing 10 and the arm 18 to urge the upstanding portion into engagement with the cam 12.

Figure 5:
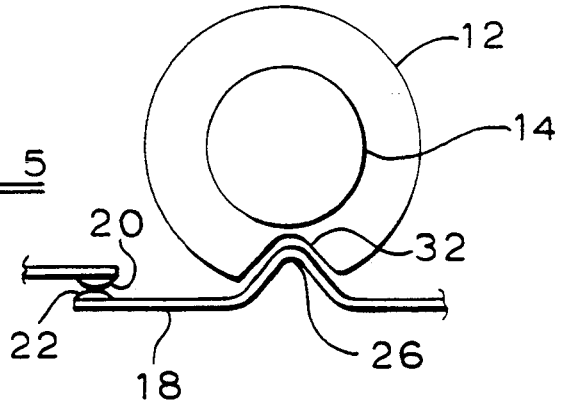
FIGS. 5 and 6 illustrate the engagement of the switch contact with a cam of the multi-position switch in known manner.
Figure 6:
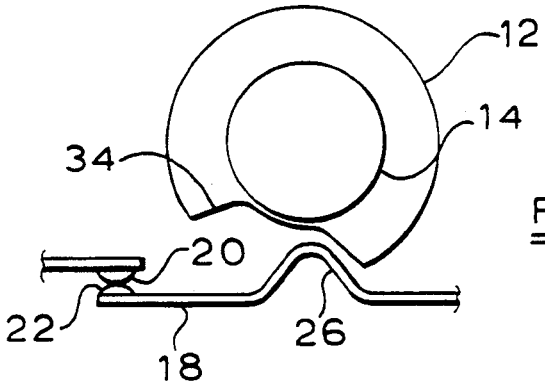

FIGS. 5 and 6 illustrate in more detail the engagement between the upstanding portion 26 of the arm 18 carrying the switch contact 22 and a cam 12.

As shown in FIG. 5 the cam 12 is formed with a cut-out defining a recessed portion 32 which is capable of receiving the upstanding portion 26 in one position of the rotatable control knob 16 thus permitting the contact 20 and 22 to close. It should be noted that FIG. 5 is merely exemplary and is included to demonstrate the method of operation of the multi-position switch. However, the cam 12 illustrated in FIG. 5 would correspond to switch contacts C1 in Table 1 above which are closed only in switch position 2 and to switch contacts C5 in Table 1 above which are closed only in switch position 6. If the control knob 16, and thus the cam 12, is rotated by one index position in either direction from the position in which the contacts 20 and 22 are closed, the cam 12 will urge the upstanding portion 26 out of the recess thereby opening the contacts 20 and 22.

As shown in FIG. 6 the cam 12 is formed with a cut-out defining a recessed portion 34, of greater circumferential extent than the recessed portion 32, which portion 34 is capable of receiving the upstanding portion 26 in two adjacent positions of the rotatable control knob 16 thus permitting the contact 20 and 22 to close in both those positions. While it should be noted that FIG. 6 is merely exemplary and is included to demonstrate the method of operation of the multi-position switch, the cam 12 illustrated in FIG. 6 would correspond to switch contacts C4 in Table 1 above which are closed in adjacent switch positions 4 and 5. If the control knob 16, and thus the cam 12, is rotated clockwise from the index position shown, the cam 12 will urge the upstanding portion 26 out of the recess thereby opening the contacts 20 and 22. However, if the control knob 16 is rotated anti-clockwise by one position from the index position shown the cam 12 will not urge the upstanding portion 26 out of the recess and the switch contacts will remain closed. Only when the control knob 16 is rotated anti-clockwise by two or more positions from the index position shown will the cam 12 urge the upstanding portion 26 out of the recess and open the contacts 20 and 22.

Clearly, where the circumferential extent of the recess extends over three or more index positions the upstanding portion 26 will be received in the cam 12 such that the contacts 20 and 22 remain closed for those three or more adjacent index positions and will only be opened when the cam is rotated beyond those positions. A cam in which the contacts remain closed for three adjacent positions corresponds to switch contacts C6 in Table 1 above which are closed in adjacent switch positions 1, 2 and 3.

The limited number of heating element configurations for the heater illustrated in FIG. 1 does not in practice permit a greater range of visible radiation for the lamp L, and thus in certain adjacent switch positions (switch positions 1, 2 and 3, subject to the bimetallic switch S being closed, and switch positions 4 and 5) there will be no change in visible radiation. However, we have found according to the present invention that it is possible to give a visual indication of a change in power output of the heater even where there is no change in the level of visible radiation. The visual indication is given by briefly de-energising the lamp when changing from one power level to another. This causes the lamp L to dim briefly and then to return to its previous brightness. Although there is no actual change in the visible radiation from the lamp when it is energised, the brief period of de-energisation does provide the user with an indication that the heater has been switched from one power output to another.

Figure 7:
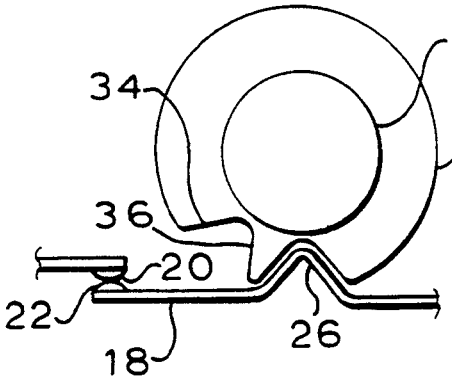
FIG. 7 illustrates the engagement of the switch contact with a cam of a multi-position switch according to the present invention.

The manner in which the visual indication is given is illustrated in FIG. 7 which corresponds to previous FIG. 6. The cam profile shown in FIG. 7 differs from that shown in FIG. 6 in that between the two adjacent positions within the recess 34 there is a protrusion 36. Thus, when the control knob 16 is moved from one index position within the recess 34 to the other index position within the recess 34 the upstanding portion 26 of the arm 18 is briefly urged out of the recess thereby briefly opening the contacts 20 and 22 and de-energising the lamp L. While the protrusion 36 could be arranged on the cam 12 corresponding to contacts C4 to briefly de-energise the lamp L between switch positions 4 and 5, it is in practice preferable to modify the cam corresponding to contacts C7 in order to minimise the current interrupted by the opening of the contacts 20 and 22.

Clearly, where the circumferential extent of the recess extends over three or more adjacent index positions, each index position can be separated from the next by a protrusion 36 causing the contacts 20 and 22 to be briefly opened and the lamp L de-energised between each adjacent pair of index positions within the recess 34. Thus, by providing two protrusions 36 in the recess of the cam 12 corresponding to switch contacts C6 it is possible briefly to open the contacts 20 and 22 and thus briefly to de-energise the lamp L between switch positions 1 and 2 and between switch positions 2 and 3.

It would not normally be desirable to provide unnecessary protrusions, such as protrusions 36, in a recess of the cam profile since this would cause unnecessary opening of the contacts and give rise to unnecessary wear of the contacts and in the switch mechanism. It can also reduce the service life of the heating elements of the radiant heater. Thus it is not essential, and may well be disadvantageous, to provide protrusions between all adjacent positions within the recesses of all the cams in the multi-position switch.

Figure 8:
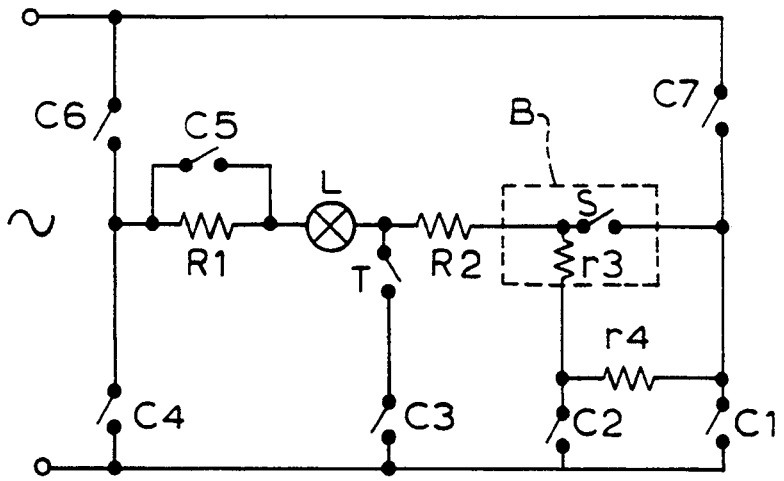
FIG. 8 is a diagrammatic illustration of another embodiment of a radiant heater and multi-position switch arrangement for an electric cooking appliance, the heater incorporating one infra-red lamp heating element and two coil heating elements.

The present invention is not limited to electric cooking appliances in which the multi-position switches have solely six heat positions and, by way of example, FIG. 8 shows a switch arrangement of a multi-position switch having eight heat positions in conjunction with a radiant heater assembly of an electric cooking appliance. As with the embodiment of FIG. 1, the radiant heater of FIG. 8 comprises a single infra-red lamp L and two resistive heating elements R1 and R2, while the switch arrangement incorporates seven sets of contacts C1, C2, C3, C4, C5, C6 and C7 which are opened or closed in accordance with Table 2 shown below:

TABLE 2

| | Switch Position | | | | | | | |
|---|---|---|---|---|---|---|---|---|
| Contacts | 8 | 7 | 6 | 5 | 4 | 3 | 2 | 1 |
| C1 | | X | | | | | X | |
| C2 | | | X | | | | | X |
| C3 | X | X | X | X | | | | |
| C4 | | | | | X | X | X | X |
| C5 | X | | | | X | | | |
| C6 | X | X | X | X | | | | |
| C7 | X | X | X | | X | X | X | X |

X = contact closed

In the embodiment of FIG. 8, the bimetallic relay B includes a heating coil r3 and bimetallic switch S. A voltage dropping resistor r4 is connected between contact C1 and the bimetallic relay B. A thermal cut-out device T is provided to prevent overheating and can be positioned elsewhere in the circuit if desired.

In use of the embodiment of FIG. 8, in switch position 8, which gives maximum power, the contacts C3, C5, C6 and C7 are closed and the resistive heating element R2 is connected in parallel with the lamp L. In switch position 7, the contacts C1, C3, C6 and C7 are closed and the resistive heating element R1 is connected in series with the lamp L, while the resistive heating element R2 is connected in parallel with the combination of the lamp L and the resistive heating element R1. Because the contact C1 is closed, power passes to the bimetallic relay B by way of the voltage dropping resistor r4 in order to reduce the power flowing through the heating coil r3 and to operate the bimetallic relay B at a first duty cycle that is increased with respect to the duty cycle of the bimetallic relay B when the power is connected directly to the heating coil r3 of the bimetallic relay.

In switch position 6, the contacts C2, C3, C6 and C7 are closed. As with switch position 7, the resistive heating element R1 is connected in series with the lamp L, while the resistive heating element R2 is connected in parallel with the combination of the lamp L and the resistive heating element R1, but in switch position 6 power passes directly to the bimetallic relay B which therefore operates at a second, lower duty cycle. In switch position 5, the contacts C3 and C6 are closed and the resistive heating element R1 is connected in series with the lamp L. In switch position 4, the contacts C4, C5 and C7 are closed and the lamp L is connected in series with the resistive heating element R2. In switch position 3, the contacts C4 and C7 are closed and the lamp L is connected in series with both the resistive heating elements R1 and R2.

In switch positions 2 and 1, contacts C4 and C7 are closed and the lamp L is connected in series with both the resistive heating elements R1 and R2 as in switch position 3. Additionally, in switch position 2, contact C1 is closed allowing power to pass through the voltage dropping resistor r4 and then through the heating coil r3 and to operate the bimetallic relay at the first duty cycle. In switch position 1, contact C2 is closed allowing power to pass directly to the heating coil r3 so as to operate the bimetallic relay at the second duty cycle. As noted above, the value of the resistor r4 is selected so that the power flowing through the heating coil r3 in switch position 1 is higher than in switch position 2 and this results in a higher duty cycle of the bimetallic relay B in switch position 2 compared with switch position 1.

To summarise, for switch positions 7 and 6 and 2 and it different voltages are created across the bimetallic relay B. In switch positions 6 and 1 the voltage is higher than in switch positions 7 and 2, the lower voltage being obtained by connecting a small external resistance r4 in series with the relay. The external resistance r4 is preferably mounted on the bimetallic relay B. It will be noted that in switch position 8, at maximum power, only one of the resistive heating elements, R2, is in use, the other heating element R1 being used in series with the lamp L as necessary at lower power levels.

The voltage dropping resistor r4 can be replaced, if desired, by a diode. The use of a diode has the advantage of reducing the effect of tolerances in component values and supply voltage fluctuations. The use of a diode cannot eliminate supply voltage fluctuations, but the effect of such fluctuations is not compounded by the effect of tolerances in the voltage dropping resistor r4.

In switch position 8 the lamp L is operating at full power and the visible radiation is at a maximum. In switch position 7 the resistive heating element R1 is connected in series with the lamp L and the visible radiation is reduced compared with switch position 8. In switch positions 6 and 5 the resistive heating element R1 is still connected in series with the lamp L and there is no change in visible radiation compared with switch position 7. In switch position 4 the lamp L is connected in series with the resistive heating element R2 and the visible radiation is reduced compared with switch position 5. In switch position 3 the lamp L is connected in series with both resistive heating elements R1 and R2 and the visible radiation is reduced compared with switch position 4. In switch positions 2 and 1 the lamp L is still connected in series with the resistive heating elements R1 and R2 and there is no change in visible radiation compared with switch position 3. Thus there is no actual change in visible radiation from the lamp L between switch positions 6 and 7, between switch positions 5 and 6, and, subject to the bimetallic switch S being closed, between switch positions 2 and 3 and between switch positions 1 and 2.

Although there is no actual change in the level of visible radiation between the switch positions noted above, we have found with the arrangement illustrated in FIG. 8 that it is possible to give a visual indication of a change in power output of the heater in accordance with the present invention by briefly de-energising the lamp when changing from one power level to another. This causes the lamp to dim briefly and then to return to its previous brightness. Although there is no actual change in the visible radiation from the lamp when it is energised, the brief period of de-energisation does provide the user with an indication that the heater has been switched from one power output to another.

It is preferable to arrange protrusions 36 on the cam corresponding to contact C6 between switch positions 6 and 7 and between switch positions 6 and 5 and on the cam corresponding to contact C7 between switch positions 3 and 2 and between switch positions 2 and 1. However, the protrusions can be provided on other cams if desired.

Figure 9:
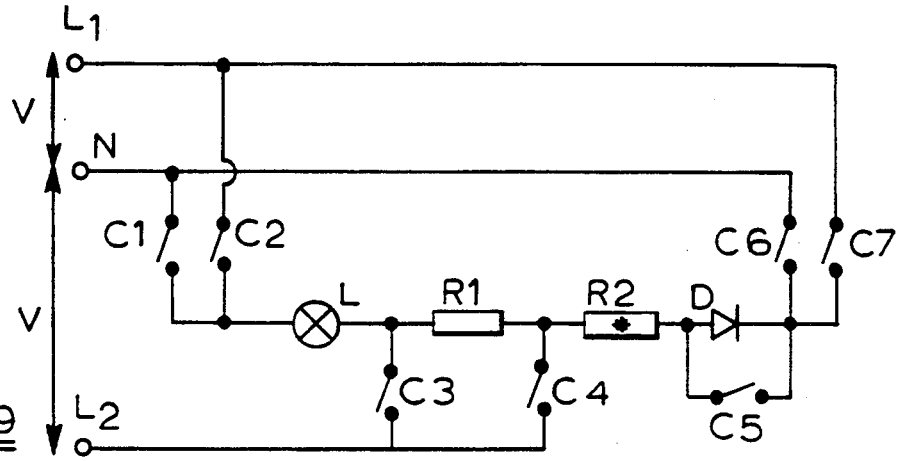
FIG. 9 is a diagrammatic illustration of a further embodiment of a radiant heater and multi-position switch arrangement for an electric cooking appliance, the heater incorporating one infra-red lamp heating element and two coil heating elements and the multi-position switch arrangement connecting the heater to a power supply system providing at least two different power supply voltages.

As a further example of the use of the present invention, FIG. 9 shows a switch arrangement of a multi-position switch having ten heat positions in conjunction with a radiant heater assembly of an electric cooking appliance. As with the embodiment of FIG. 1, the radiant heater comprises a single infra-red lamp L and two resistive heating elements R1 and R2. Also shown are seven switch contacts C1, C2, C3, C4, C5, C6 and C7 of a seven pole, eleven way switch which is provided for the user to control the heater power level, and rectifier D, which can conveniently be mounted in proximity to the switch and is used selectively to block half-cycles of a.c. power supply current to provide some of the desired heating power levels. Table 3 below shows which switch contacts are closed for each user-selected position of the control switch; in the eleventh (off) position all contacts are open.

TABLE 3

| | 1 | 2 | 3 | 4 | 5 | 6 | 7 | 8 | 9 | 10 |
|---|---|---|---|---|---|---|---|---|---|---|
| C1 | | | | X | X | X | X | X | | |

TABLE 3-continued

| | 1 | 2 | 3 | 4 | 5 | 6 | 7 | 8 | 9 | 10 |
|---|---|---|---|---|---|---|---|---|---|---|
| C2 | | X | | | | | | | X | X |
| C3 | X | | X | | | | | X | | X |
| C4 | | | | X | X | X | X | | X | |
| C5 | | X | X | | | X | | X | | X |
| C6 | X | X | X | | X | X | | | | |
| C7 | | | | | | | X | X | X | X |

X = contact closed

Figure 10:
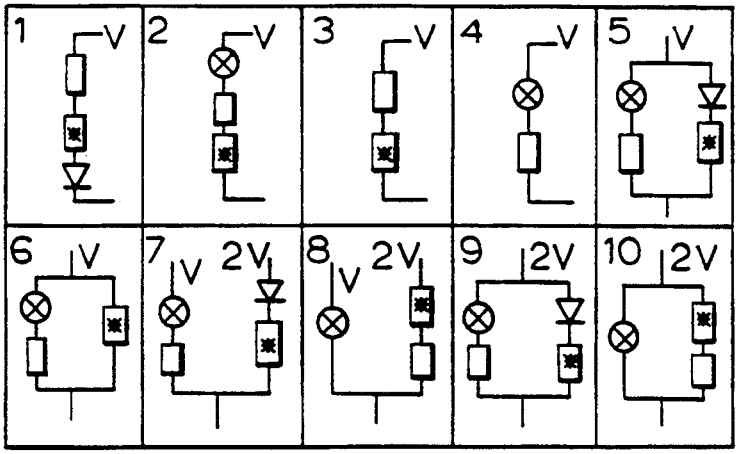
FIG. 10 is a schematic illustration of the circuit arrangement which exists for each state of the multi-position switch arrangement shown in FIG. 9.

FIG. 10 indicates schematically which of the heating elements are actively included in the circuit for each switch position; for clarity the heating element R2 is identified in FIG. 9, and also in FIG. 10, by an asterisk.

The circuit shown in FIG. 9 is intended to be coupled to a two-phase a.c. electricity supply having a neutral line N and two live lines $L_1$ and $L_2$. The lines $L_1$ and $L_2$ are each at a voltage V (typically 120 volts) relative to the neutral line N; in addition the phase relationship between the lines $L_1$ and $L_2$ is such that they are at a voltage 2 V (typically 240 volts) relative to one another.

The switch contacts are connected as follows:

C1: between the neutral line N and the lamp L;

C2: between the live line $L_1$ and the lamp L;

C3: between the live line $L_2$ and the junction between the lamp L and the heating element R2;

C4: between the live line $L_2$ and the junction between the heating elements R1 and R2;

C5: across the rectifier D which is itself connected to the heating element R2;

C6: between the rectifier D and the neutral line N; and

C7: between the rectifier D and the live line $L_1$.

In switch position 1 (the lowest power setting), both heating elements R1 and R2 are connected in series, and in series with the rectifier D (see FIG. 12). In switch position 2 both heating elements R1 and R2 are connected in series and are connected in series with the lamp L, but without the rectifier D; thus both half-cycles of the a.c. supply are passed by the circuit, and the power dissipation is correspondingly higher.

In switch position 3 only the heating elements R1 and R2 are connected in series; since the total circuit resistance is therefore lower than with both elements R1 and R2 and lamp L together, the power dissipation is higher. In switch position 4 the lamp L is connected in series with the heating element R1. The circuit in switch position 5 is similar to that in switch position 4 except that the heating element R2 is connected in series with the rectifier D and the combination of the heating element R2 and rectifier D is connected in parallel with the combination of the lamp L and the heating element R1. The circuit in switch position 6 is similar to that in switch position 5, except that the rectifier D is omitted (switch contact C5).

In all six switch positions 1 to 6 current is taken solely via the live line $L_1$ or the live line $L_2$ and the neutral line N, at a voltage V.

In switch position 7 the lamp L is connected in series with the heating element R1 and the combination is supplied with current via the live line $L_2$ and the neutral line N (switch contacts C1 and C4), at a voltage V, and the heating element R2 is connected in series with the rectifier D and this combination is supplied with current via the live lines $L_1$ and $L_2$ (switch contacts C4 and C7), at a voltage 2 V.

In switch position 8 the lamp L is supplied with current via the live line $L_2$ and the neutral line (switch contacts C1 and C3), at a voltage V, and the heating elements R1 and R2 are connected in series and are supplied with current via the live lines $L_1$ and $L_2$ (switch contacts C3, C5 and C7), at a voltage 2 V.

Switch position 9 is similar to position 7, but with the lamp L and the heating element R1 supplied with current via the live lines $L_1$ and $L_2$ (switch contact C2), at a voltage 2 V, while switch position 10 is similar to switch position 8, but with the lamp L supplied with current via the live lines $L_1$ and $L_2$ (switch contact C2), at a voltage 2 V.

In switch position 10 the voltage is at 2 V and the lamp L is operating at full power with the visible radiation at a maximum. In switch position 9 the resistive heating element R1 is connected in series with the lamp L at voltage 2V and the visible radiation is reduced compared with switch position 10. In switch position 8 the voltage is reduced to V and the visible radiation is reduced compared with switch position 9. In switch position 7 the resistive heating element R1 is connected in series with the lamp L at voltage V and the visible radiation is reduced compared with switch position 8. In switch positions 6, 5 and 4 the resistive heating element R1 is still connected in series with the lamp L at voltage V and there is no change in visible radiation compared with switch position 7. In switch position 3 the lamp L is not energised, while in switch position 2 the lamp is connected in series with both resistive heating elements R1 and R2 and emits no discernible visible radiation. In switch position 1 the lamp L is again not energised. Thus there is no actual change in visible radiation from the lamp L between switch positions 6 and 7, between switch positions 5 and 6 and between switch positions 4 and 5.

Although there is no actual change in the level of visible radiation between the switch positions noted above, we have found with the arrangement illustrated in FIGS. 9 and 10 that it is possible to give a visual indication of a change in power output of the heater in accordance with the present invention by briefly de-energising the lamp when changing from one power level to another. This causes the lamp to dim briefly and then to return to its previous brightness. Although there is no actual change in the visible radiation from the lamp when it is energised, the brief period of de-energisation does provide the user with an indication that the heater has been switched from one power output to another.

It is preferable to arrange protrusions 36 on the cam corresponding to contact C1 between switch positions 7 and 6, between switch positions 6 and 5, and between switch positions 5 and 4. However, the protrusions can be provided on other cams if desired.

I claim:

1. Apparatus for providing a visual indication in a heater of an electric cooking appliance, the appliance incorporating a user-operable multi-position switch for switching the heater from one power output to another, and the heater incorporating at least one heating element which is capable of emitting a significant amount of visible radiation, and having multiple positive power outputs wherein the apparatus includes means for de-energising and subsequently re-energising the at least one heating element as the heater is switched from one positive power output to another, to thereby produce a brief dimming of brightness of the one heating element, and the desired visual indication.

2. Apparatus according to claim 1, wherein the heater incorporates at least one further heating element which, in use, does not emit a significant amount of visible radiation.

3. Apparatus according to claim 1 in which the at least one heating element is capable of emitting a plurality of distinct levels of visible radiation fewer than the plurality of distinct heat settings of the heater selectable from the multi-position switch, wherein the apparatus includes means for de-energising and subsequently re-energising the at least one heating element only between adjacent heat settings in which there is no substantial change in the level of visible radiation.

4. Apparatus according to claim 1, wherein the heater is configured such that the level of visible radiation from the at least one heating element does not reduce as the heat output setting of the heater increases.

5. Apparatus for providing a visual indication in a heater of an electric cooking appliance, the appliance incorporating a user-operable multi-position switch for switching the heater from one power output to another, and the heater incorporating at least one heating element which is capable of emitting a significant amount of visible radiation, and having multiple positive power outputs wherein the multi-position switch is a mechanical switch incorporating a plurality of rotatable cams for switching the heater from one power output to another, and wherein at least one of the cams is profiled such as to de-energise and to subsequently re-energise the at least one heating element as the heater is switched from one positive power output to another, to thereby produce a brief dimming of brightness of the one heating element, and the desired visual indication.

* * * * *